US009327504B2

(12) United States Patent
Tanaka et al.

(10) Patent No.: US 9,327,504 B2
(45) Date of Patent: May 3, 2016

(54) LIQUID EJECTING APPARATUS AND LIQUID SUPPLY APPARATUS

(71) Applicant: SEIKO EPSON CORPORATION, Tokyo (JP)

(72) Inventors: Takeshi Tanaka, Shiojiri (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/513,102

(22) Filed: Oct. 13, 2014

(65) Prior Publication Data

US 2015/0029260 A1 Jan. 29, 2015

Related U.S. Application Data

(63) Continuation of application No. 13/963,839, filed on Aug. 9, 2013, now Pat. No. 8,931,882.

(30) Foreign Application Priority Data

Aug. 17, 2012 (JP) ..... 2012-180801

(51) Int. Cl.

| | |
|---|---|
| ***B41J 29/38*** | (2006.01) |
| ***B41J 2/165*** | (2006.01) |
| ***B41J 2/175*** | (2006.01) |
| ***B41J 25/34*** | (2006.01) |

(52) U.S. Cl.

CPC ..... *B41J 2/16517* (2013.01); *B41J 2/16579* (2013.01); *B41J 2/17546* (2013.01); *B41J 25/34* (2013.01); *B41J 2002/16573* (2013.01)

(58) Field of Classification Search

CPC ..... B41J 2/16517
USPC ..... 347/6, 30–31
See application file for complete search history.

(56) References Cited

U.S. PATENT DOCUMENTS

| | | | | |
|---|---|---|---|---|
| 6,276,784 | B1 * | 8/2001 | Ikkatai et al. | 347/85 |
| 6,474,798 | B1 * | 11/2002 | Shinada et al. | 347/86 |
| 2008/0143763 | A1 * | 6/2008 | Sakurai | 347/6 |
| 2009/0058894 | A1 | 3/2009 | Nakazawa | |
| 2009/0073201 | A1 * | 3/2009 | Watanabe et al. | 347/9 |
| 2009/0213171 | A1 * | 8/2009 | Uchida | 347/30 |
| 2011/0216111 | A1 | 9/2011 | Katoh | |
| 2012/0194620 | A1 * | 8/2012 | Matsumoto et al. | 347/85 |
| 2012/0262516 | A1 * | 10/2012 | Yamazaki | B41J 2/17509 347/20 |

FOREIGN PATENT DOCUMENTS

| | | |
|---|---|---|
| JP | 2002-200772 | 7/2002 |

* cited by examiner

*Primary Examiner* — Jason Uhlenhake
(74) *Attorney, Agent, or Firm* — Workman Nydegger

(57) ABSTRACT

A liquid ejecting apparatus includes a carriage having a removable liquid receptacle that holds a liquid or a removable connector connected via a flexible liquid channel to an external liquid receptacle that holds a liquid, an ejecting head, mounted in the carriage, that has a nozzle that ejects the liquid, and a maintenance unit that runs maintenance on the ejecting head; the ejecting head has a filter disposed so as to be capable of contact with a liquid absorption member provided in the liquid receptacle and in the connector.

18 Claims, 7 Drawing Sheets

| CARTRIDGE REMOVAL TIME | LESS THAN 5 MINUTES | 5 – 30 MINUTES | MORE THAN 30 MINUTES |
|---|---|---|---|
| MAINTENANCE PROCESS | DO NOT RUN | MAINTENANCE MODE 1 | MAINTENANCE MODE 2 |

LIQUID EJECTING APPARATUS AND LIQUID SUPPLY APPARATUS

CROSS-REFERENCE TO RELATED APPLICATIONS

This application is a continuation application of U.S. patent application Ser. No. 13/963,839, filed Aug. 9, 2013, which patent application is incorporated herein by reference in its entirety. U.S. patent application Ser. No. 13/963,839 claims the benefit of Japanese Patent Application No. 2012-180801 filed Aug. 17, 2012, the contents of which are hereby incorporated by reference in its entirety.

BACKGROUND

1. Technical Field

The present invention relates to liquid ejecting apparatuses.

2. Related Art

Ink jet recording apparatuses, in which an ejecting head and cartridges are disposed in a carriage that makes scans above a recording medium and a desired printing process is performed by ejecting ink (a liquid) supplied from the cartridges onto the recording medium from the ejecting head (recording head), are known as liquid ejecting apparatuses that have been used in the past. A connection method that employs ink supply pins is known as a technique for connecting the ejecting head and the cartridges in such an ink jet recording apparatus (for example, see JP-A-2002-200772).

Incidentally, rather than mounting cartridges on the carriage, it is also conceivable to employ a method in which a connector is mounted on the carriage and connected to an external tank disposed outside of the recording apparatus via a flexible supply channel, and ink is supplied to the ejecting head from the external tank by connecting the connector to ink supply pins in the ejecting head.

With the connection method that employs ink supply pins such as that described above, it is necessary to dispose a filter, for collecting foreign objects and the like entering from the exterior, within an ink flow channel in the ejecting head. It is necessary to ensure a certain amount of surface area for the filter in order to reduce pressure loss occurring when the ink passes through the filter, and is therefore necessary to perform maintenance operations, such as suction operations or the like for discharging bubbles produced at a widened ink channel formed above the filter between the ink supply pin and the filter.

In the type of ink jet recording apparatus where the cartridges are mounted on the carriage, the maintenance operations for discharging bubbles produced at the widened ink channel are normally carried out automatically when the cartridges are replaced (this will be referred to as "replacement cleaning").

However, in the case of employing the aforementioned method in which a connector is mounted in the ink jet recording apparatus instead of cartridges and the ink is supplied to the ejecting head from an external tank, the connector is never replaced after being mounted; accordingly, there is a problem in that the replacement cleaning is not executed automatically, and thus ejection problems and the like caused by bubbles being produced at the widened ink channel are not ameliorated.

What is needed, therefore, is a new technique that enables favorable ink ejection properties to be achieved even in the case of employing a method in which a connector is mounted on a carriage instead of cartridges being mounted on the carriage and ink is supplied to an ejecting head from an external tank.

SUMMARY

It is an advantage of some aspects of the invention to provide a liquid ejecting apparatus capable of achieving favorable ink ejection properties even in the case of employing a method in which a sub tank (a connector) connected to an ink tank (an external liquid receptacle) disposed outside of a recording apparatus is mounted instead of cartridges (liquid receptacles) that are normally mounted and ink is supplied to an ejecting head from the ink tank (the external liquid receptacle).

A liquid ejecting apparatus according to an aspect of the invention includes a carriage having a removable liquid receptacle that holds a liquid or a removable connector connected via a flexible liquid channel to an external liquid receptacle that holds a liquid, an ejecting head, mounted in the carriage, that has a nozzle that ejects the liquid, and a maintenance unit that runs maintenance on the ejecting head; the ejecting head includes a filter disposed so as to be capable of contact with a liquid absorption member provided in the liquid receptacle and in the connector.

Here, it is preferable that a configuration in which a detection unit capable of detecting whether the liquid receptacle is attached or removed is further provided and the maintenance unit runs the maintenance on the ejecting head based on a detection result of the detection unit detecting whether the liquid receptacle is attached or removed be employed.

According to this configuration, the ejecting head is provided with a filter disposed so as to be capable of making contact with the liquid receptacle and the liquid absorption member provided in the connector, and thus it is not necessary to provide a filter within the ejecting head and a widened liquid channel formed above the filter, which are necessary when employing a connection technique that uses supply pins. As a result, maintenance such as a suction operation for discharging bubbles from a liquid channel in the ejecting head can be performed less frequently, and thus favorable liquid ejection properties can be achieved even in the case of employing a technique in which an external liquid receptacle and a connector connected by a flexible liquid channel are provided instead of the liquid receptacle and a liquid is supplied to the ejecting head from the external liquid receptacle. In addition, because whether the liquid receptacle is attached or removed can be detected by the detection unit, the maintenance unit can, based on the detection result, run the maintenance on the ejecting head at the timing when the liquid receptacle is replaced.

Here, it is preferable that a configuration be such that the maintenance unit runs the maintenance in the case where an amount of time elapsed since the liquid receptacle was removed, calculated based on the detection result, has exceeded a predetermined amount of time.

In addition, it is preferable that a configuration be such that the maintenance unit includes a capping mechanism that discharges the liquid from the nozzle of the ejecting head by applying a suction force, and changes the suction force of the capping mechanism or an amount of the liquid discharged from the nozzle during the maintenance based on the amount of time that has elapsed since the liquid receptacle was removed.

According to this configuration, the maintenance unit can change the suction force acting on the capping mechanism or the amount of liquid discharged from the nozzle during the maintenance based on the amount of time that has elapsed since the liquid receptacle was removed as calculated based on the detection result; accordingly, favorable liquid ejection properties can be obtained without performing wasteful maintenance operations, wasteful liquid discharge, or the like.

It is preferable that a liquid ejecting apparatus according to another aspect of the invention be configured so as to include an external liquid receptacle holding unit having a removable external liquid receptacle that holds a liquid, and a connector that is connected to the external liquid receptacle holding unit via a flexible liquid channel and that has a liquid absorption member disposed so as to be capable of making contact with the filter of the ejecting head when the connector is mounted in the carriage.

According to this configuration, favorable liquid ejection properties can be obtained even in a liquid ejecting apparatus that employs a technique in which the liquid is supplied to the ejecting head from the external liquid receptacle.

Here, it is preferable that a configuration be such that a position where the liquid absorption member and the filter make contact with each other when the connector is mounted in the carriage is higher in the vertical direction than a position corresponding to a pressure head of the liquid within the external liquid receptacle when the external liquid receptacle is attached to the external liquid receptacle holding unit.

According to this configuration, in the case where the connector is mounted or removed from the carriage, the connector is not fully mounted to the carriage, and so on, the liquid can be prevented from leaking from the liquid absorption member and soiling the interior of the apparatus, the periphery, and so on even if a meniscus formed at a gas-liquid interface where the liquid absorption member and the filter make contact has broken due to impacts or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
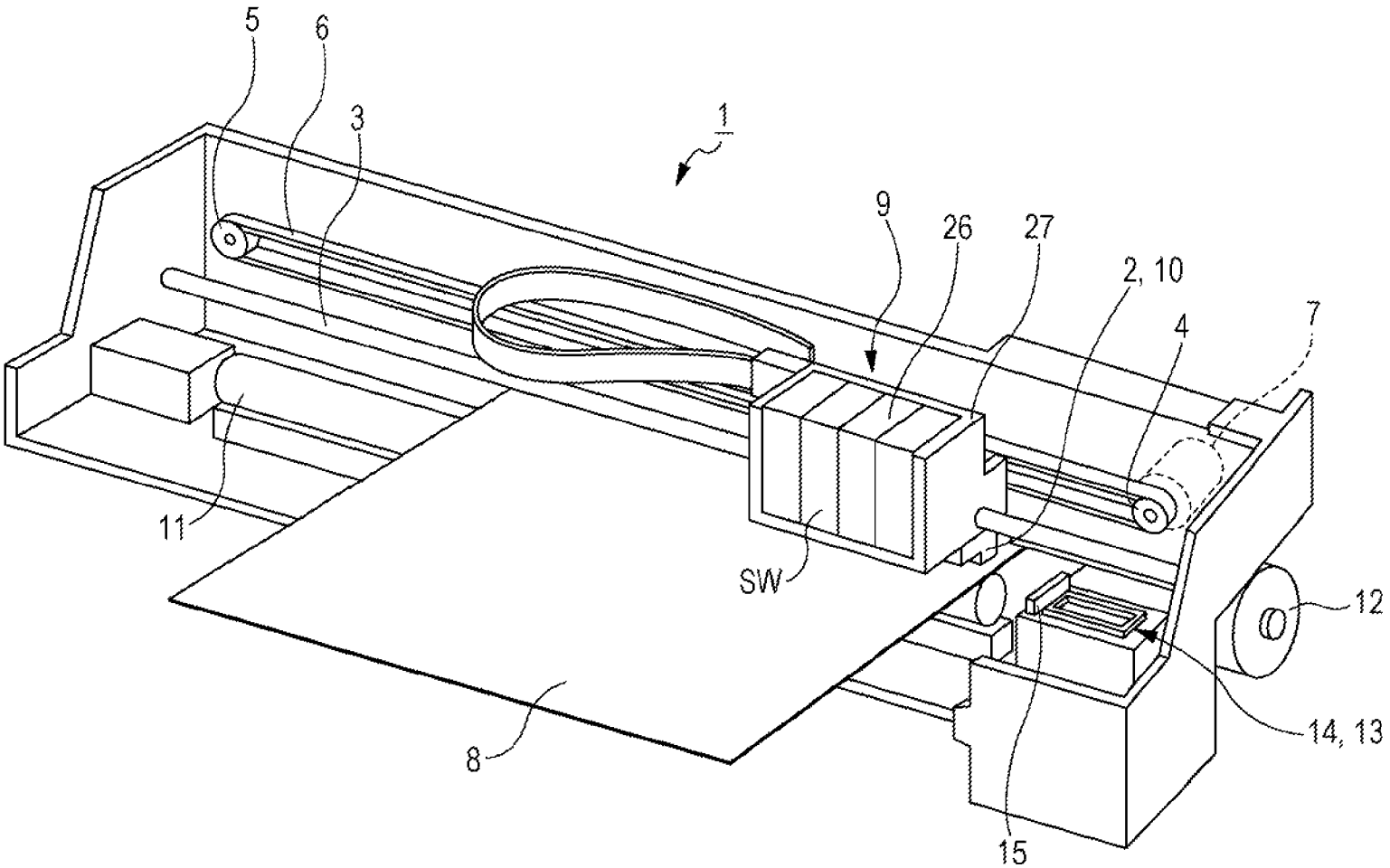
FIG. 1 is a diagram illustrating the overall configuration of a printer according to a first embodiment.

Hereinafter, embodiments of the invention will be described with reference to the drawings. Note that in the drawings, the scale of the various members is illustrated as being different from the actual scale in order to enable those members to be visible in the drawings. The following embodiments describe examples of a liquid ejecting apparatus embodied as an ink jet printer (called simply a "printer" hereinafter).

FIG. 1 is a diagram illustrating the overall configuration of a printer according to a first embodiment.

A printer (liquid ejecting apparatus) 1 includes a head unit (carriage) 2 that is attached in a mobile state to a guide shaft 3, as shown in FIG. 1.

The head unit (carriage) 2 is connected to a timing belt 6 that is stretched between a driving pulley 4 and a slave pulley 5. The driving pulley 4 is connected to a rotational shaft of a driving motor 7. Accordingly, the head unit (carriage) 2 moves in a width direction (a main scanning direction) of a recording medium 8 under the driving of the driving motor 7.

A paper feed roller 11 that is parallel to the guide shaft 3 is disposed below the guide shaft 3. The paper feed roller 11 rotates under a driving force from a paper feed motor 12 when the recording medium 8 is transported. Accordingly, a printing process is carried out while the recording medium 8 is transported in a length direction (a sub scanning direction).

A home position is set within the movement range of the head unit (carriage) 2 but outside of a recording region, and a recording head (ejecting head) 10 is positioned at the home position when standing by for printing operations and so on.

A maintenance device (maintenance unit) 13 that performs maintenance processes on the recording head 10 is disposed at the home position. The maintenance device 13 is configured of a capping mechanism 14 capable of sealing a nozzle surface of the recording head 10 when in a non-recording state.

The capping mechanism 14 performs a suction process that forcefully discharges ink from nozzles NZ by making contact with a nozzle formation surface 10*a* of the recording head 10 in which the nozzles NZ are formed and depressurizing the surrounding area of the nozzle formation surface 10*a*. Note that in addition to the capping mechanism 14, the maintenance device 13 also includes a wiping member 15 that wipes the nozzle formation surface 10*a* after the suction process has been carried out.

Figure 2:
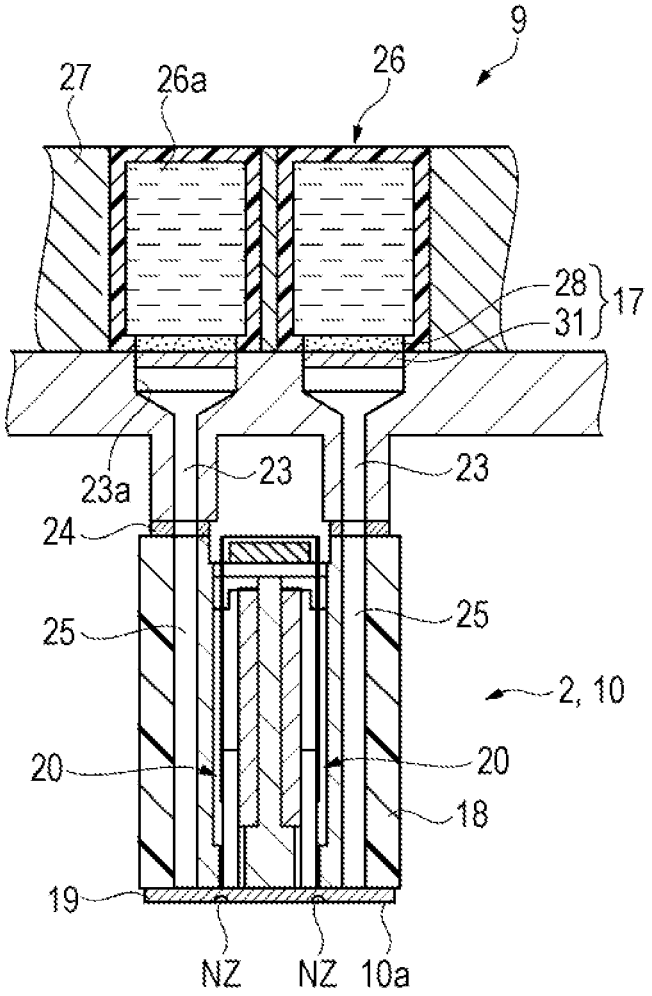
FIG. 2 is a diagram illustrating the configuration of an ink supply channel in a head unit according to the first embodiment.
Figure 3:
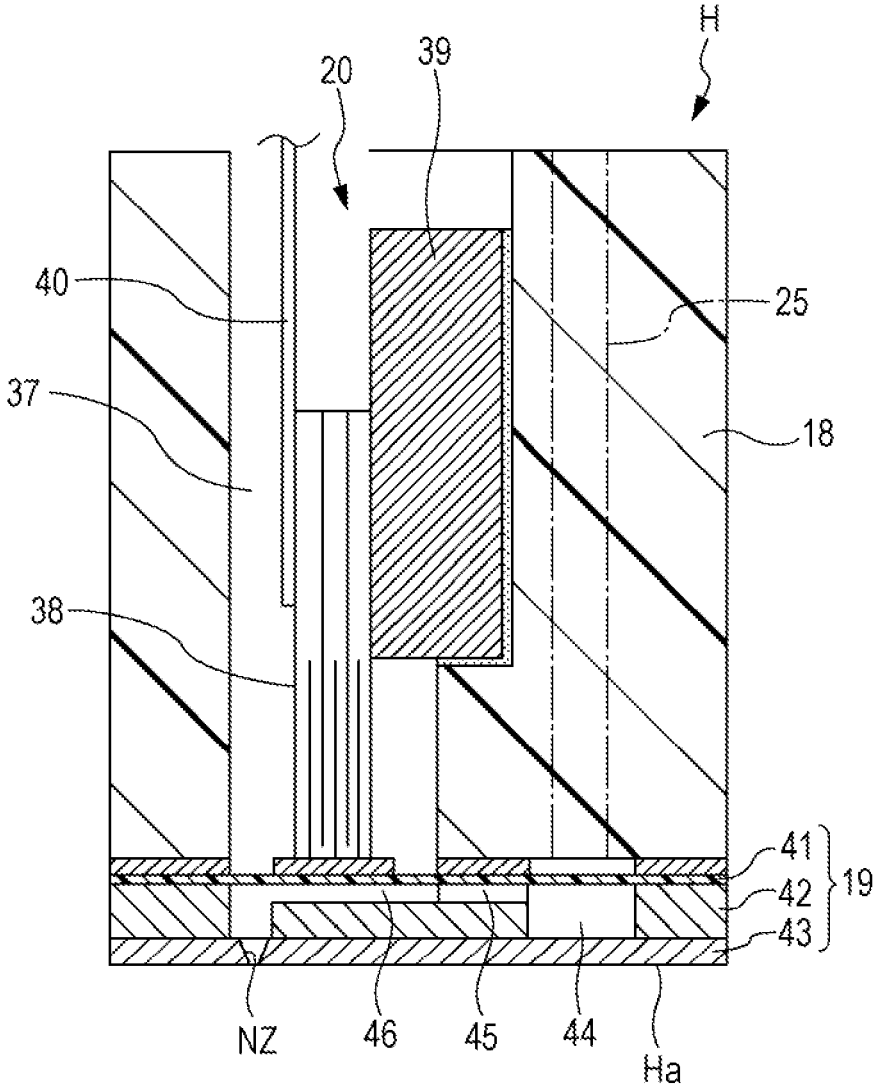
FIG. 3 is a diagram illustrating the configuration of a recording head serving as a main constituent element of a head unit.

FIG. 2 is a diagram illustrating the configuration of an ink supply channel in the head unit 2 according to the first embodiment. FIG. 3, meanwhile, is a diagram illustrating the configuration of the recording head 10 serving as a main constituent element of the head unit 2.

As shown in FIG. 2, the head unit (carriage) 2 includes a cartridge unit 9, the recording head 10, and an ink supply unit (liquid supply unit) 17 that supplies ink from the cartridge unit 9 to the recording head 10. The recording head 10 includes a head case 18, a flow channel unit 19, and an actuator unit 20.

The cartridge unit 9 includes a cartridge holder unit 27 and a plurality of ink cartridges (liquid receptacles) 26 mounted in the cartridge holder unit 27. The plurality of ink cartridges 26 are attached to the cartridge holder unit 27 in a removable state. Each ink cartridge 26 is configured with an ink holding chamber 26*a* that holds an ink liquid, or in other words, ink in liquid form (a liquid), as its main entity. An ink absorption member (liquid absorption member) 28 is provided in each ink holding chamber 26*a*. The ink absorption member (liquid absorption member) 28 makes contact with the ink contained in the ink holding chamber 26*a*, and thus the surface thereof is soaked with ink. A member capable of forming a meniscus on its surface (a gas-liquid interface), and a porous member, nonwoven fabric, or the like such as a foamed resin including polyethylene and polypropylene, can be employed for the ink absorption member (liquid absorption member) 28.

Specifically, the ink cartridges 26 in this embodiment respectively hold, for example, yellow (Y), magenta (M), cyan (C), and black (K) color inks. Accordingly, four colors of ink can be ejected onto the recording medium 8 from the recording head 10.

Meanwhile, a detection unit SW (not shown) that detects whether or not the ink cartridges 26 are attached is provided in the cartridge holder unit 27. A variety of techniques can be employed for the detection unit SW as long as the techniques are capable of detecting whether or not the ink cartridges 26 are present in the cartridge holder unit 27; for example, contact switches, reflective-type photo sensors, or the like may be disposed at locations of the cartridge holder unit 27 that correspond to the respective ink cartridges 26, and may be used to detect the presence/absence of the ink cartridges 26. In the case where the ink cartridges 26 are provided with circuit boards including a storage element that stores information regarding the ink held in the corresponding ink cartridge 26, the presence/absence of the ink cartridges 26 may be detected based on whether or not the information regarding the ink can be obtained, or whether an electrical connection is established, via electrical contact connectors disposed in locations of the cartridge holder unit 27 that correspond to the respective ink cartridges 26.

The ink supply unit 17 is configured of the aforementioned ink absorption member 28 provided in the corresponding ink cartridge 26 and a filter unit (filter) 31 provided within an ink conducting channel 23 of the recording head 10. The filter unit 31, meanwhile, is configured of a mesh-form member through which the ink can pass. A metallic thin plate-shaped member in which small holes are formed, a member created by twilling together metallic filaments, or the like can be employed as the filter unit (filter) 31. Note that the ink conducting channel 23 configures an ink flow channel in the recording head 10 through which ink supplied from the corresponding ink cartridge 26 flows (see FIG. 3).

When the ink cartridge 26 is attached to the cartridge holder unit 27, the filter unit 31 is disposed in a position that makes contact with the ink absorption member 28. Specifically, the filter unit 31 is disposed at an entrance 23*a* to the ink conducting channel 23, and the entrance 23*a* is a widened section whose width is greater than that of the other flow channel areas. Note that because the filter unit 31 also functions as a filter for collecting foreign objects and the like that have entered into the ink flow channel of the recording head 10 from the exterior, it is not necessary to provide a separate filter and corresponding widened section that is needed above the filter.

By making contact with the ink absorption member 28 of the ink cartridge 26, the filter unit 31 enables the interior of the ink pack 26*a* and the ink conducting channel 23 to communicate. Accordingly, the ink can be supplied to the recording head 10 from the ink pack 26*a* via the ink conducting channel 23, and the ink can be ejected from the nozzles NZ of the recording head 10 (see FIG. 3).

As shown in FIG. 3, the head case 18 is formed of a synthetic resin or the like. The head case 18 is formed in, for example, a box shape having a hollow section. The flow channel unit 19 is joined to a lower end surface of the head case 18. The actuator unit 20 is housed within a hollow section 37 formed inside the head case 18.

In addition, a case flow channel 25 is provided in the head case 18, passing therethrough in the height direction.

An upper end of the case flow channel 25 communicates with the ink conducting channel 23 via a gasket 24. A lower end of the case flow channel 25 communicates with a common ink chamber 44 within the flow channel unit 19. Accordingly, ink that has been conducted from the ink supply unit 17 is supplied to the common ink chamber 44 through the ink conducting channel 23 and the case flow channel 25.

The actuator unit 20 includes a plurality of piezoelectric vibrators 38 disposed in, for example, a comb-tooth shape, an anchor plate 39 that holds the piezoelectric vibrators 38, and a flexible cable 40 that supplies driving signals to the piezoelectric vibrators 38 from a control device 106.

The piezoelectric vibrators 38 are anchored, at the lower ends thereof in FIG. 3, to the anchor plate 39 so as to protrude from a lower end surface thereof. In this manner, each of the piezoelectric vibrators 38 is attached to the anchor plate 39 in a so-called cantilever state. The anchor plate 39 that supports the respective piezoelectric vibrators 38 is configured of, for example, stainless steel that is approximately 1 mm thick. Of the anchor plate 39, the surface thereof that is on, for example, the different surface from the surface to which the piezoelectric vibrators 38 are anchored is joined to a case inner wall surface that partitions the hollow section 37.

The flow channel unit 19 includes a vibrating plate 41, a flow channel substrate 42, and a nozzle substrate 43. The vibrating plate 41, the flow channel substrate 42, and the nozzle substrate 43 are joined together in a stacked state. The flow channel unit 19 configures a continuous ink flow channel (liquid flow channel) that spans from the common ink chamber 44, through ink supply openings 45 and pressure chambers 46, to the nozzles NZ. The pressure chambers 46 are formed so as to extend in a lengthwise direction that corresponds to the direction orthogonal to the direction in which the nozzles NZ are arranged (a nozzle row direction).

The common ink chamber 44 is connected to the case flow channel 25. The common ink chamber 44 is a chamber into which ink is conducted from the ink conducting channel 23. The common ink chamber 44 is also connected to the ink supply openings 45. The ink conducted into the common ink chamber 44 is distributed to the respective pressure chambers 46 through the ink supply openings 45.

The nozzle substrate 43 is disposed on a base area of the flow channel unit 19. The plurality of nozzles NZ are formed in the nozzle substrate 43 at a pitch that corresponds to the dot formation density of images and the like formed on the recording medium 8 (for example, 180 dpi). A plate member made of a metal such as stainless steel or the like is used as the nozzle substrate 43. A lower surface of the nozzle substrate 43 configures the nozzle formation surface 10*a* in which a plurality of nozzle openings are formed.

Figures 4, 5:
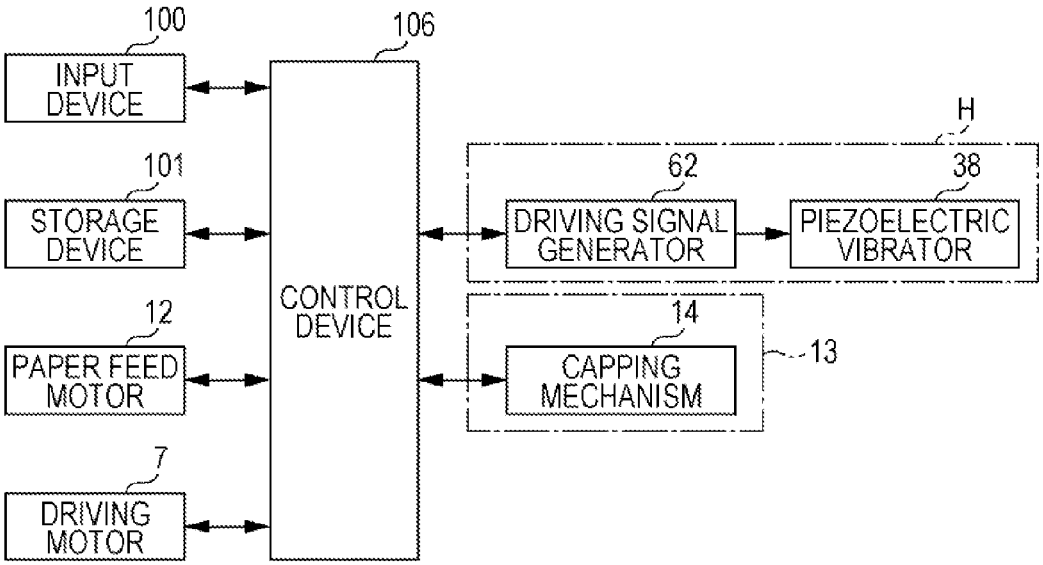
FIG. 4 is a block diagram illustrating the electrical configuration of a printer.
FIG. 5 is a diagram illustrating an example of conditions used when determining whether or not a printer according to an embodiment will run a maintenance operation.

FIG. 4 is a block diagram illustrating the electrical configuration of the printer 1. The printer 1 includes the control unit 106, which controls the overall operations of the printer 1.

An input device 100 that inputs various types of information related to the operation of the printer 1, a storage device 101 that stores various types of information related to the operation of the printer 1, and so on are connected to the control device 106, and the aforementioned paper feed motor 12, the driving motor 7 that drives the recording head 10, and so on are also connected to the control device 106.

In addition, the control device 106 performs control for ejecting predetermined amounts of ink from the nozzles NZ by applying driving signals to the piezoelectric vibrators 38 via a driving signal generator 62. The control device 106 also controls the capping mechanism 14 of the maintenance device 13 and so on.

Incidentally, in the printer 1, an operation for replacing the ink cartridge 26 is performed in the case where there is no more ink in the ink holding chamber 26*a*. At this time, when the ink cartridge 26 is removed from the cartridge holder unit 27, the filter unit 31 provided at the entrance 23*a* of the ink conducting channel 23, corresponding to one part of the ink supply unit 17, is exposed to the external atmosphere. Ink evaporates from the surface of the filter unit 31 when the filter unit 31 is exposed to the external atmosphere. In the ink supply unit 17 according to this embodiment, the free surface area of the filter unit 31 is greater than that in ink supply pin systems employed in past printers. Accordingly, it is easy for ink to evaporate when the ink cartridges 26 are replaced.

The ink evaporating from the surface of the filter unit 31 also means that ink will evaporate from the ink conducting channel 23 and the internal flow channels that the ink conducting channel 23 communicates with (that is, the case flow channel 25, the common ink chamber 44, the ink supply openings 45, the pressure chambers 46, and so on). In other words, "ink evaporating from the surface of the filter unit 31" can also be referred to as the evaporation of ink within the ink flow channels between the filter unit 31 and the nozzles NZ.

When ink evaporates in this manner, the pressure within the recording head 10 (the nozzles NZ) (that is, an internal pressure) rises. In the case where the internal pressure in the nozzles NZ exceeds the pressure that the ink menisci can withstand, the ink menisci at the nozzles NZ will break. In the case where the menisci have broken, it is necessary to perform maintenance operations, using the maintenance device 13, to restore the menisci.

On the other hand, in the case where the internal pressure in the nozzles NZ has not exceeded the pressure that the ink menisci can withstand, the ink menisci will not break, and thus it is not necessary to perform the aforementioned maintenance operations. In other words, with the printer 1, even in the case where ink evaporates from the filter unit 31 due to operations for replacing the ink cartridges 26, the evaporation of ink is permitted when the internal pressure of the nozzles NZ is a pressure at which the ink menisci will not break; this makes it possible to render maintenance operations performed by the maintenance device 13 unnecessary.

The printer 1 according to this embodiment runs maintenance operations performed by the maintenance device 13 in the case where, due to the ink cartridges 26 being replaced, an ink evaporation amount at the filter unit 31 has exceeded an evaporation amount that breaks the ink menisci in the nozzles NZ. Accordingly, the maintenance operations can be run as appropriate only when those maintenance operations are necessary, and thus ink is not wasted as a result of unnecessary maintenance.

The printer 1 obtains information regarding the amount of ink that has evaporated from the filter unit 31 based on an amount of time for which the ink cartridges 26 are removed, the amount of time calculated based on a result of the detection unit SW detecting whether the ink cartridges 26 are attached/removed. Conditions specifying a relationship between the amount of time for which the ink cartridges 26 are removed and the ink evaporation amount can be calculated by performing, in advance, experiments, simulations, or the like that employ, as parameters, the surface area of the filter unit 31, the volume of the ink flow channel, the type of the ink, external environmental conditions (temperature, humidity), and so on.

FIG. 5 is a diagram illustrating an example of conditions used when determining whether or not the printer 1 according to this embodiment will run a maintenance operation. In FIG. 5, the case where the cartridge removal time is less than 5 minutes corresponds to a case where the ink evaporation amount has not reached an evaporation amount sufficient to break the ink menisci. The case, in FIG. 5, where the cartridge removal time is 5-30 minutes corresponds to a case where the ink evaporation amount has exceeded the evaporation amount sufficient to break the ink menisci. The case, in FIG. 5, where the cartridge removal time is more than 30 minutes corresponds to a case where the ink evaporation amount has exceeded the evaporation amount sufficient to break the ink menisci and much of the ink within the ink flow channel has evaporated.

A maintenance mode 1 uses the capping mechanism 14 to perform a suction operation at a low suction force. Meanwhile, a maintenance mode 2 uses the capping mechanism 14 to perform choke suction or the like at a high suction force.

Based on such a configuration, the printer 1 estimates the ink evaporation amount by measuring the time for which the ink cartridges 26 are removed, and the states of the ink menisci in the nozzles NZ can therefore be estimated. Accordingly, the printer 1 is capable of determining whether or not to run maintenance operations using the maintenance device 13, as well as the type of maintenance operation to be run.

Next, operations performed by the printer 1 having the above configuration will be described. Note that the main subject of the following descriptions is maintenance operations, which are a characteristic part of this application.

When a job instruction for starting printing is inputted, the control device 106 drives the paper feed motor 12, and drives the recording head 10 by applying voltages to the piezoelectric vibrators 38 via the driving signal generator 62 while transporting the recording medium 8. Through this, the recording head 10 can perform a desired printing process by ejecting ink from the nozzles NZ onto predetermined locations of the recording medium 8 that is transported immediately therebelow by the paper feed motor 12.

During the printing process, the printer 1 supplies ink to the recording head 10 from the ink cartridges 26. Through this, the printer 1 can continue the printing process by consecutively ejecting ink onto the recording medium 8.

The ink within the ink packs 26*a* is exhausted when the printing process is continued. In this case, it is necessary to replace the ink cartridges 26. When the ink cartridges 26 are removed from the cartridge holder unit 27, the printer 1 performs a procedure for determining whether or not to run maintenance operations based on the ink evaporation amount calculated from the cartridge removal time as described above.

Figure 6:
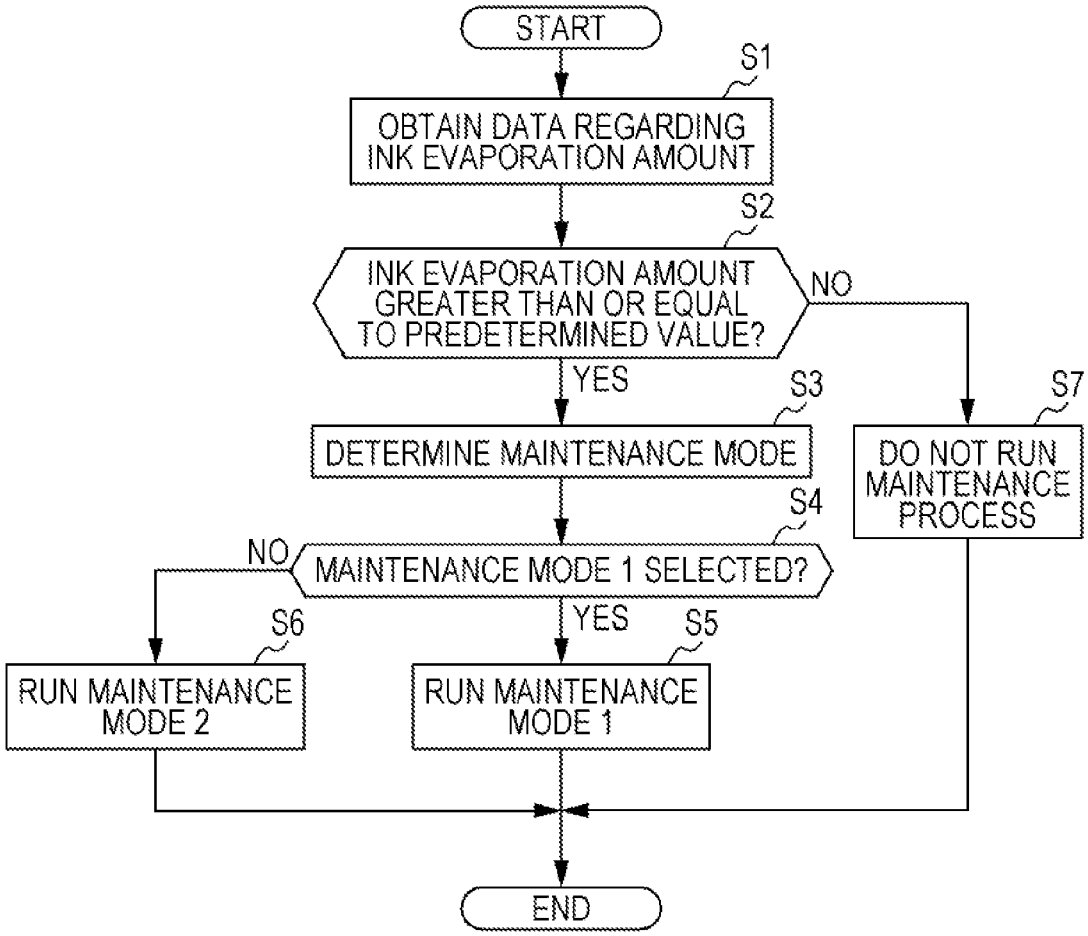
FIG. 6 is a flowchart illustrating steps in a maintenance operation determination.

FIG. 6 is a flowchart illustrating steps in the maintenance operation determination procedure.

As shown in FIG. 6, when the ink cartridges 26 are removed, the printer 1 measures the cartridge removal time. Then, the printer 1 obtains data regarding the ink evaporation amount from the cartridge removal time based on the conditions illustrated in FIG. 5 (step S1).

The printer 1 determines whether or not the ink evaporation amount is greater than a predetermined value based on the obtained data regarding the ink evaporation amount (step S2). Specifically, in this embodiment, the printer 1 determines whether or not the ink cartridges 26 have been removed for less than 5 minutes.

Here, in the case where the cartridge removal time is greater than or equal to 5 minutes, the printer 1 determines whether the ink evaporation amount has exceeded an evaporation amount that breaks the ink menisci. The printer 1 then determines the maintenance mode (step S3). When determining the maintenance mode, the printer 1 determines that one of the maintenance mode 1 and a maintenance mode 2 is to be selected.

In the case where the maintenance mode 1 is selected (YES), the procedure advances to step S5. The printer 1 then drives the maintenance device 13 based on the maintenance mode 1. In the maintenance mode 1, the nozzle formation surface 10*a* of the recording head 10 is sealed by driving the capping mechanism 14, and a suction operation that depressurizes a resulting airtight space at a low suction force is carried out. After the suction operation is performed, the nozzle formation surface 10*a* is wiped by the wiping member 15. Note that a flushing process may also be performed as necessary.

The ink menisci that were broken by running the maintenance mode 1 can be favorably restored. Accordingly, the ink ejection properties of the recording head 10 can also be restored by restoring the ink menisci.

On the other hand, in the case where the maintenance mode 2 has been selected (NO), the procedure advances to step S6. The printer 1 then drives the maintenance device 13 based on the maintenance mode 2. In the maintenance mode 2, the nozzle formation surface 10*a* of the recording head 10 is sealed by driving the capping mechanism 14, and a choke suction operation that depressurizes a resulting airtight space at a high suction force is carried out. By performing the choke suction operation, an ink flow channel in a dry state can be refilled with the ink from the ink cartridges 26. After the suction operation is performed, the nozzle formation surface 10*a* is wiped by the wiping member 15. Note that a flushing process may also be performed as necessary.

Meanwhile, in the case where the cartridge removal time is less than 5 minutes, the printer 1 determines that the ink menisci have not been broken, and does not run a maintenance process (step S7). In other words, the printer 1 does not drive the maintenance device 13.

According to the embodiment as described thus far, maintenance operations are run only in the case where enough ink has evaporated to break the ink menisci, and thus maintenance can be performed efficiently and without wasting ink.

Furthermore, the information regarding the ink evaporation amount can be obtained simply by managing the removal time of the ink cartridges 26. Accordingly, it is not necessary to provide a separate measurement unit for measuring the ink evaporation amount, which makes it possible to simplify the device configuration of the printer 1 and achieve a reduction in costs.

In addition, the printer 1 selectively runs the maintenance modes 1 and 2 by changing the suction force of the capping mechanism 14 based on the ink evaporation amount. Accordingly, it is possible to avoid wasting ink by carrying out maintenance optimized for the situation.

Second Embodiment

A printer (liquid ejecting apparatus) 101 according to a second embodiment will now be described. The difference between this embodiment and the first embodiment lies in the peripheral structure of an ink supply mechanism IS that corresponds to the ink cartridges (liquid receptacles) 26 of the first embodiment; the rest of the configuration is the same. Accordingly, the following will describe only the peripheral structure of the ink supply mechanism IS, and descriptions of the rest of the configuration will be omitted or simplified. Note that configurations and members that are the same as in the first embodiment will be described as having the same reference numerals.

Figure 7:
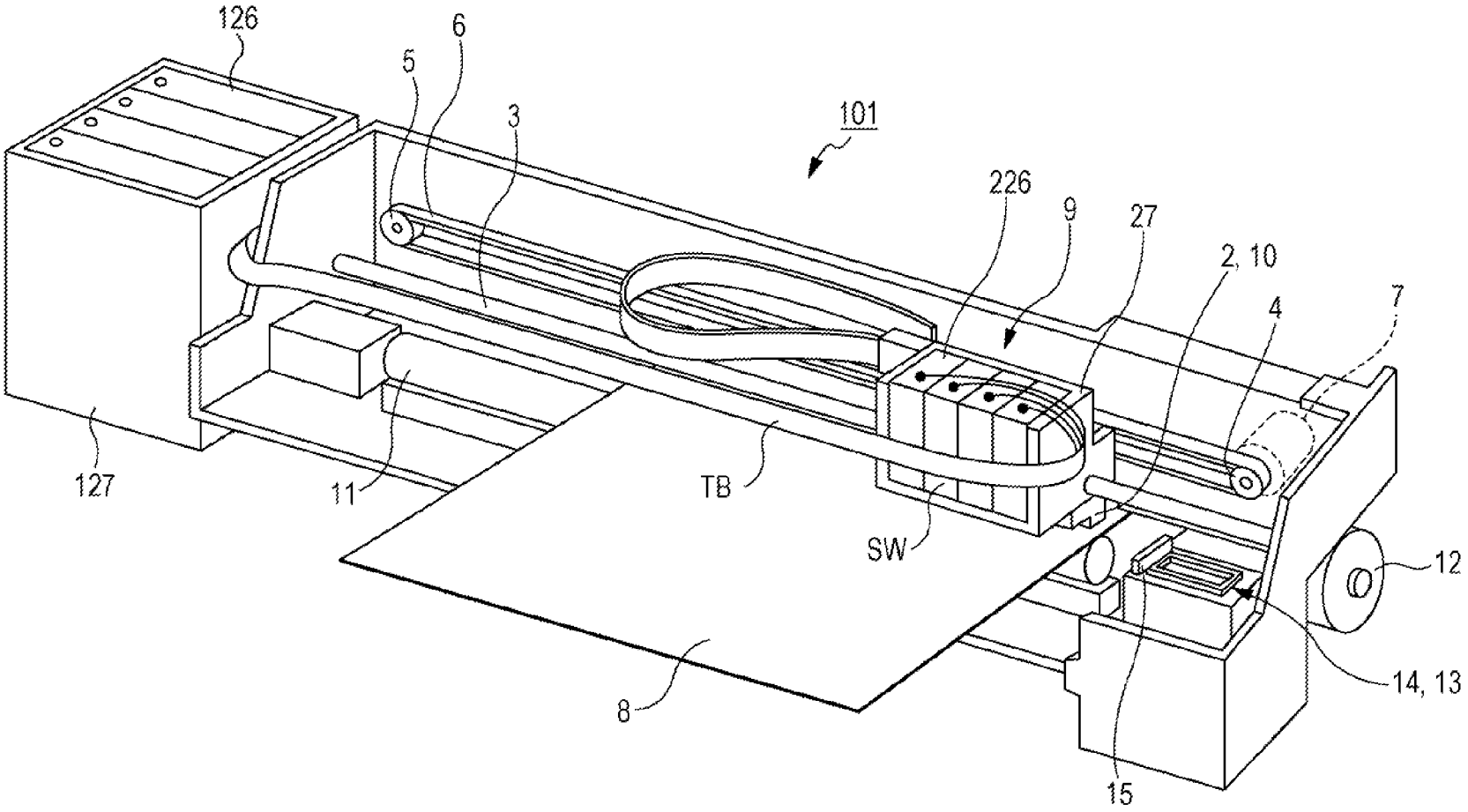
FIG. 7 is a diagram illustrating the overall configuration of a printer according to a second embodiment.

FIG. 7 is a diagram illustrating the overall configuration of a printer according to the second embodiment.

Instead of the ink cartridges (liquid receptacles) 26 of the first embodiment, the ink supply mechanism IS supplies ink to the recording head (ejecting head) 10 from ink tanks (external liquid receptacles) 126 that are contained in a different location than the head unit (carriage) 2. The ink supply mechanism IS includes a tank holder unit (external liquid receptacle holding unit) 127 and a plurality of sub tanks (connectors) 226 that are mounted in the cartridge holder unit 27 instead of the ink cartridges 26 of the first embodiment. Furthermore, flexible supply tubes (liquid channels) TB that connect the tank holder unit 127 to the plurality of sub tanks (connectors) 226 are provided in order to supply ink from the ink tanks (external liquid receptacles) 126 mounted in the tank holder unit 127 to the recording head (ejecting head) 10.

Figure 8:
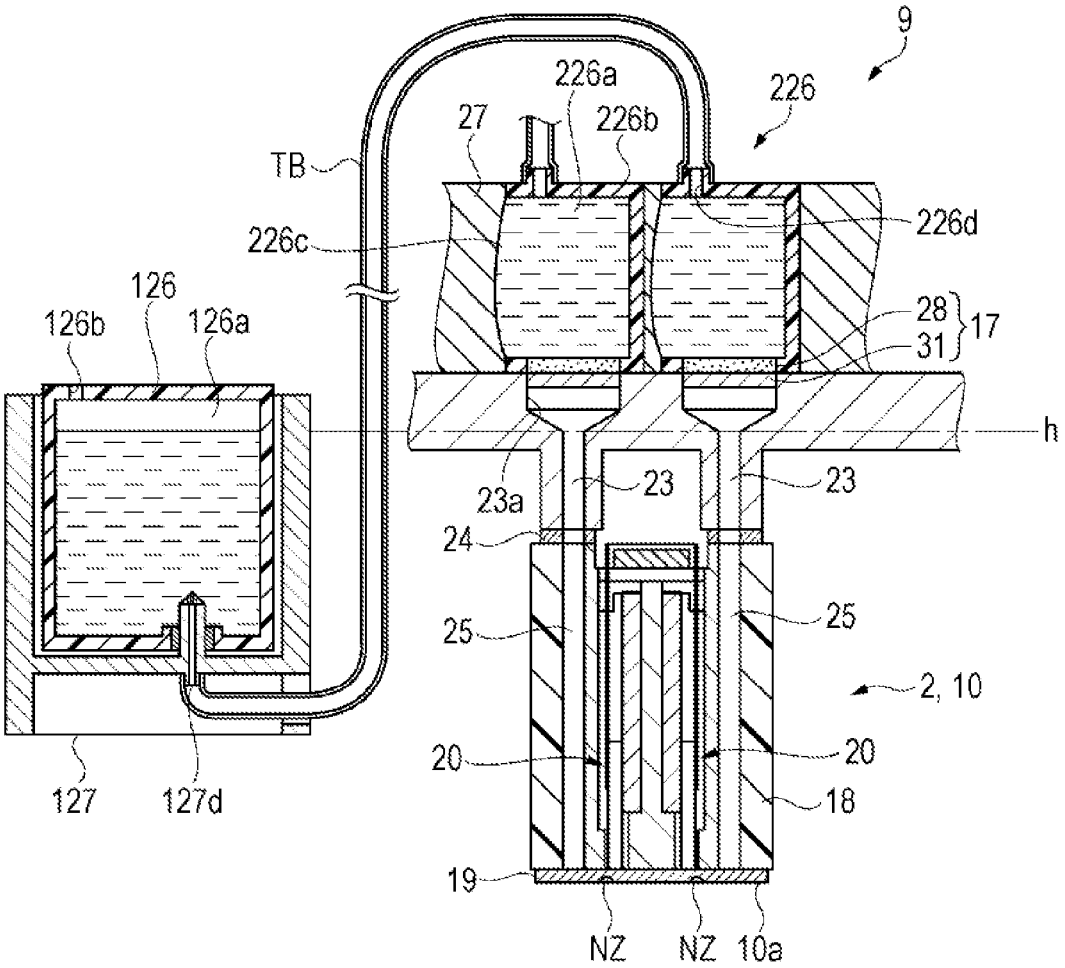
FIG. 8 is a diagram illustrating the configuration of an ink supply channel in a head unit and an ink supply mechanism according to the second embodiment.

FIG. 8 is a diagram illustrating the configuration of the ink supply channel in the head unit and the ink supply mechanism IS according to the second embodiment.

The plurality of sub tanks (connectors) 226 are attached to the cartridge holder unit 27 in a removable state. Each sub tank 226 is configured with an ink holding chamber 226*a* that holds an ink liquid, or in other words, ink in liquid form (a liquid), as its main entity. The ink holding chamber 226*a* is formed, for example, by affixing a flexible film member 226*c* in a fluid-tight state to an opening section provided in a case member 226*b* of which the sub tank 226 is partially configured. In this case, if the same material, such as polyethylene or polypropylene, is employed for the surfaces of the case member 226*b* and the film member 226*c* that are affixed to each other, the ink holding chamber 226*a* can be formed easily through thermal welding. The film member 226*c* has an effect of absorbing fluctuations in pressure applied to the ink within the ink holding chamber 226*a* caused by the head unit (carriage) 2 moving and the like.

The ink absorption member (liquid absorption member) 28 is provided in each ink holding chamber 226*a*. The ink absorption member (liquid absorption member) 28 makes contact with the ink contained in the ink holding chamber 226*a*, and thus the surface thereof is soaked with ink. A member capable of forming a meniscus on its surface (a gas-liquid interface), and a porous member, nonwoven fabric, or the like such as a foamed resin including polyethylene and polypropylene, can be employed for the ink absorption member (liquid absorption member) 28. In the case where the liquid used is ink, and the ink absorption member is a porous member, a nonwoven fabric, or the like, converting the pressure-resistance of a meniscus formed on the surface (the gas-liquid interface) into a capillary height results in a capillary height of approximately 80-120 mm. Meanwhile, a filter-like member, in which small holes through which the ink can pass are formed in a film-form member, can also be employed as the ink absorption member (liquid absorption member) 28, and in this case, converting the pressure-resistance of the meniscus into a capillary height results in a capillary height of approximately 500 mm.

One end of each supply tube (liquid channel) TB is connected to the ink holding chamber 226*a* of the corresponding sub tank (connector) 226 via a communication hole 226*d*, whereas the other end is connected to an ink connection section 127*d* provided in the tank holder unit (external liquid receptacle holding unit) 127; the ink within the ink tanks (external liquid receptacles) 126 mounted in the tank holder unit (external liquid receptacle holding unit) 127 is supplied to the recording head (ejecting head) 10. In the case where there is a plurality of sub tanks (connectors) 226 or ink tanks (external liquid receptacles) 126, a multi-channel tube, in which a plurality of liquid channels are formed so as to correspond to the number of the stated tanks, can be employed as the supply tube (liquid channel) TB.

Each of the ink tanks (external liquid receptacles) 126 is an open-ended ink tank including an ink holding section 126*a* that holds the ink and an atmosphere communication hole 126*b* that is located above the ink holding section 126*a* and that opens the ink holding section 126*a* to the atmosphere. It is desirable for the position h of a liquid surface of the ink within the ink tanks (external liquid receptacles) 126 mounted in the tank holder unit (external liquid receptacle holding unit) 127 (that is, a position corresponding to the pressure head of the liquid) to be set lower, in the vertical direction, than a position where the ink absorption members (liquid absorption members) 28 and the filter units (filters) 31 make contact when the sub tanks (connectors) 226 are mounted to the head unit (carriage) 2.

According to this configuration, in the case where the sub tanks (connectors) 226 are mounted or removed from the head unit (carriage) 2, the sub tanks (connectors) 226 are not fully mounted to the head unit (carriage) 2, and so on, ink can be prevented from leaking from the ink absorption members (liquid absorption members) 28 and soiling the interior of the apparatus, the periphery, and so on even if the menisci formed at the gas-liquid interface where the ink absorption members (liquid absorption members) 28 and the filter units (filters) 31 make contact have broken due to impacts or the like.

As another form for the ink tanks (external liquid receptacles) 126, an open-ended tank structure in which the ink holding section 126*a* is open to the atmosphere via an opening on an upper end of a communication pipe that extends from a lower end of the ink holding section 126*a* can be employed. In this case, the position h that corresponds to the pressure head of the ink (liquid) within the ink tank (external liquid receptacle) 126 matches the position of the opening on the upper end of the communication pipe. Alternatively, a pack formed of a flexible film member (an airtight structure), a structure in which the ink is added to the ink holding section 126*a*, or the like may be employed as the ink holding section 126*a*.

The detection unit SW (not shown) of the printer 1 according to the first embodiment is provided in the printer 101 according to the second embodiment as well, and thus the maintenance operations are run using the maintenance device 13 in the case where the ink evaporation amount at the filter unit 31, calculated based on a result of detecting whether the sub tanks (connectors) 226 are attached/removed, has exceeded the evaporation amount at which the ink menisci in the nozzles NZ will break.

In the case where the ink supply mechanism IS is employed, it is basically unnecessary to replace the ink tanks (external liquid receptacles) 126, and it is basically unnecessary to replace or remove the sub tanks (connectors) 226 in the case where ink is added to the ink holding units in the ink tanks (external liquid receptacles) 126. Accordingly, although the aforementioned maintenance operations are less frequently run by the maintenance device 13, the ink supply unit 17 is configured of the ink absorption members 28 provided in the sub tanks (connectors) 226 and the filter unit (filter) 31 provided in the ink conducting channels 23 of the recording head 10 in the same manner as with the printer 1 according to the first embodiment, and thus the production of bubbles in the flow channel can be reduced and favorable liquid ejection properties can be obtained from the recording head 10.

Although the first embodiment and the second embodiment describe printers, the invention is not limited to the aforementioned embodiments, and variations thereon can be made as appropriate without departing from the essential scope of the invention. For example, although the aforementioned embodiments describe a case where it is determined whether or not to run the maintenance operations based on the ink evaporation amount in the ink flow channels between the filter units 31 and the nozzles NZ, it may instead be determined whether or not it is possible to run maintenance operations by comparing the size of bubbles within the ink flow channels between the filter units 31 and the nozzles NZ calculated based on a result of the detection unit SW detecting whether the ink cartridges (liquid receptacles) 26 or the sub tanks (connectors) 226 are attached/removed with a bubble size at which poor liquid ejection properties are obtained from the recording head 10.

In addition, on/off valves (pressure adjustment valves) that open the communication holes 226*d* from a closed state when the pressure within the ink holding chambers 226*a* of the sub tanks (connectors) 226 has dropped below a predetermined negative pressure may be provided. This can be realized by, for example, disposing compressed springs within the ink holding chambers 226*a* so as to bias the flexible film members 226*c* in a direction that expands the volume of the ink holding chambers 226*a*, where the on/off valves open as the film members 226*c* displace upon the ink holding chambers 226*a* reaching the predetermined negative pressure.

In addition, the position h of the liquid surface of the ink within the ink tanks (external liquid receptacles) 126 mounted in the tank holder unit (external liquid receptacle holding unit) 127 (that is, the position corresponding to the pressure head of the liquid) may be set lower, in the vertical direction, than a position at which the ink absorption members (liquid absorption members) 28 and the filter units (filters) 31 make contact when the sub tanks (connectors) 226 are mounted in the head unit (carriage) 2, which is higher by an amount equivalent to the capillary height of the menisci formed at the gas-liquid interfaces where the ink absorption members (liquid absorption members) 28 and the filter units (filters) 31 make contact.

According to this configuration, in the case where ink is added to the ink tanks (external liquid receptacles) 126, ink is suppressed from leaking from the ink absorption members (liquid absorption members) 28 and soiling the device interior, the periphery, and so on by the capillary strength of the menisci formed at the gas-liquid interface where the ink absorption members (liquid absorption members) 28 and the filter units (filters) 31 make contact, even in the case where the sub tanks (connectors) 226 are not completely mounted to the head unit (carriage) 2.

Accordingly, the same effect can be achieved even when the upper surfaces of the ink holding units 126*a* within the ink tanks (external liquid receptacles) 126 mounted in the tank holder unit (external liquid receptacle holding unit) 127 are set lower, in the vertical direction, than a position at which the ink absorption members (liquid absorption members) 28 and the filter units (filters) 31 make contact when the sub tanks (connectors) 226 are mounted in the head unit (carriage) 2, which is higher by an amount equivalent to the capillary height of the menisci formed at the gas-liquid interfaces where the ink absorption members (liquid absorption members) 28 and the filter units (filters) 31 make contact.

Furthermore, although the embodiments and variations describe the liquid ejecting apparatus as being the printers 1 and 101, the invention is not limited thereto. The liquid ejecting apparatus may be an apparatus such as a copier, a facsimile device, or the like.

Furthermore, a recording apparatus that ejects and discharges a fluid aside from ink may be employed as the liquid ejecting apparatus. The invention can be applied, for example, in various types of recording apparatuses provided with recording heads that eject extremely small-volume liquid droplets. Note that "droplet" refers to the state of the liquid ejected from the recording apparatus, and is intended to include granule forms, teardrop forms, and forms that pull tails in a string-like form therebehind. Furthermore, the "liquid" referred to here can be any material capable of being ejected by the recording apparatus. For example, any matter can be used as long as the matter is in its liquid state, including liquids having high or low viscosity, sol, gel water, other inorganic agents, inorganic agents, liquid solutions, liquid resins, and fluid states such as liquid metals (metallic melts); furthermore, in addition to liquids as a single state of a matter, liquids in which the molecules of a functional material composed of a solid matter such as pigments, metal particles, or the like are dissolved, dispersed, or mixed in a liquid carrier are included as well. In addition, although ink (ultraviolet light-curable ink) as described in the aforementioned embodiments is given as a representative example of a liquid, the liquid need not be an ultraviolet light-curable ink as long as the liquid has a high viscosity. Furthermore, in addition to paper, plastic films such as vinyl chloride film, and the like, functional paper that is heated and stretched thin, circuit boards, metal plates, and so on are included as the recording medium.

What is claimed is:

1. A liquid ejecting apparatus comprising:

an ejecting head that includes a nozzle that ejects the liquid;

an apparatus main body;

an external liquid receptacle holding unit that holds a liquid receptacle capable of holding the liquid, wherein the external liquid holding receptacle is external to the apparatus main body;

a connecter that includes a liquid holding chamber that is provided with a communication hole, the liquid holding chamber holding the liquid from the liquid external receptacle via the communication hole;

a carriage that holds the connecter, the carriage being internal to the apparatus main body; and a flexible liquid channel that is configured to supply the liquid from the liquid receptacle to the liquid holding chamber via the external liquid receptacle holding unit, one end of the flexible liquid channel being connected to the liquid holding chamber via the communication hole, wherein the connector includes a contact member having a contact part that is disposed so as to be capable of making contact with a filter provided in the ejecting head, the contact member being formed with a material capable of forming a meniscus so that the contact part forms the meniscus when the contact part does not make contact with the filter, wherein the contact member has an inner part located in the liquid held in the liquid holding chamber, the contact member does not form a meniscus when the contact part makes contact with the filter and the liquid is ejected from the nozzle.

2. The liquid ejecting apparatus according to claim 1, further comprising:

a maintenance unit that runs maintenance on the ejecting head; and a detection unit capable of detecting whether the connector is attached or removed, wherein the maintenance unit runs the maintenance on the ejecting head based on a detection result of the detection unit detecting whether the connector is attached or removed.

3. The liquid ejecting apparatus according to claim 2, wherein the maintenance unit runs the maintenance in the case where an amount of time elapsed since the connector was removed, calculated based on the detection result, has exceeded a predetermined amount of time.

4. The liquid ejecting apparatus according to claim 2, wherein the maintenance unit includes a capping mechanism that discharges the liquid from the nozzle of the ejecting head by applying a suction force, and changes the suction force of the capping mechanism or an amount of the liquid discharged from the nozzle during the maintenance based on the amount of time that has elapsed since the connector was removed.

5. The liquid ejecting apparatus according to claim 1, wherein a position where the contact part and the filter make contact with each other when the connector is held in the carriage is higher in the vertical direction than a position corresponding to a pressure head of the liquid within the external liquid receptacle when the external liquid receptacle is attached to the external liquid receptacle holding unit.

6. The liquid ejecting apparatus according to claim 1, wherein a position where the contact part and the filter make contact with each other when the connector is held in the carriage is higher in the vertical direction than a position lower an amount from a liquid surface of the liquid within the external liquid receptacle when the external liquid receptacle is attached to the external liquid receptacle holding unit, the amount being equivalent to a capillary height of the meniscus that the liquid forms on the contact part.

7. The liquid ejecting apparatus according to claim 1, wherein a position where the contact part and the filter make contact with each other when the connector is held in the carriage is higher in the vertical direction than a position lower an amount from an upper surface of the external liquid receptacle when the external liquid receptacle is attached to the external liquid receptacle holding unit, the amount being equivalent to a capillary height of the meniscus that the liquid forms on the contact part.

8. A liquid supply apparatus that supply a liquid to an ejecting head provided with a liquid ejecting apparatus, the liquid supply apparatus comprising:

an external liquid receptacle holding unit that holds a liquid receptacle capable of holding a liquid, the external liquid receptacle being located outside of the liquid ejecting apparatus;

a flexible liquid channel that is configured to supply the liquid from the liquid receptacle toward the ejecting head via the external liquid receptacle holding unit; and a connector that is connected to the external liquid receptacle holding unit via the flexible liquid channel and is detachable with the ejecting head, the connector including:

a liquid holding chamber that provides with a communication hole, the liquid holding chamber holding the liquid from the liquid receptacle via the communication hole; and a contact member having a contact part that is disposed so as to be capable of making contact with a filter provided in the ejecting head, the contact member being formed with a material capable of forming a meniscus so that the contact part forms the meniscus when the contact part does not make contact with the filter, wherein the contact member has an inner part located in the liquid held in the liquid holding chamber so that the contact member does not form a meniscus when the contact part makes contact with the filter and the liquid is ejected from the nozzle.

9. The liquid supply apparatus according to claim 8, wherein the connector includes a spring that is disposed in the liquid holding chamber, the spring biasing the flexible part in a direction that expands a volume of the liquid holding chamber, the direction being different from a direction toward the contact part.

10. The liquid supply apparatus according to claim 8, wherein the connector includes a pressure regulating valve that switches a communication state and a non-communication state between the liquid holding chamber and the external liquid receptacle holding unit.

11. The liquid supply apparatus according to claim 8, further comprising:

the liquid receptacle that is mounted to the external liquid receptacle holding unit.

12. The liquid supply apparatus according to claim 8, wherein the liquid receptacle includes a liquid storage chamber that is capable of store the liquid and an opening configured so as to open the liquid storage chamber to atmosphere.

13. The liquid supply apparatus according to claim 12, wherein the liquid receptacle includes the opening on an upper end of a communication pipe that extends from a lower end of the liquid storage chamber, wherein a position where the contact part and the filter make contact with each other when the connector is held in the carriage is higher in the vertical direction than the opening when the external liquid receptacle is attached to the external liquid receptacle holding unit.

14. The liquid supply apparatus according to claim 8, wherein the liquid receptacle is a form that a liquid is added to the liquid storage chamber from outside in a state of being mounted to the external liquid receptacle holding unit.

15. The liquid supply apparatus according to claim 8, wherein a position where the contact part and the inlet part make contact with each other when the connector is held in the carriage is higher in the vertical direction than a position corresponding to a pressure head of the liquid within the external liquid receptacle when the external liquid receptacle is attached to the external liquid receptacle holding unit.

16. The liquid supply apparatus according to claim 8, wherein a position where the contact part and the inlet part make contact with each other when the connector is held in the carriage is higher in the vertical direction than a position lower an amount from a liquid surface of the liquid within the external liquid receptacle when the external liquid receptacle is attached to the external liquid receptacle holding unit, the amount being equivalent to a capillary height of the meniscus that the liquid forms on the contact part.

17. The liquid supply apparatus according to claim 8, wherein a position where the contact part and the inlet part make contact with each other when the connector is held in the carriage is higher in the vertical direction than a position lower an amount from an upper surface of the external liquid receptacle when the external liquid receptacle is attached to the external liquid receptacle holding unit, the amount being equivalent to a capillary height of the meniscus that the liquid forms on the contact part.

18. The liquid supply apparatus according to claim 8, wherein the contact part is formed of a nonwoven fabric.

* * * * *